US012084923B2

(12) United States Patent
Anda

(10) Patent No.: US 12,084,923 B2
(45) Date of Patent: Sep. 10, 2024

(54) TUBE WIRE ANCHOR AND METHOD OF OPERATING THE SAME

(71) Applicant: TARGET Intervention AS, Ålgård (NO)

(72) Inventor: Roger Anda, Kleppe (NO)

(73) Assignee: TARGET Intervention AS, Ålgård (NO)

( * ) Notice: Subject to any disclaimer, the term of this patent is extended or adjusted under 35 U.S.C. 154(b) by 0 days.

(21) Appl. No.: 18/009,225

(22) PCT Filed: Jun. 24, 2021

(86) PCT No.: PCT/NO2021/050150
§ 371 (c)(1),
(2) Date: Dec. 8, 2022

(87) PCT Pub. No.: WO2021/262008
PCT Pub. Date: Dec. 30, 2021

(65) Prior Publication Data

US 2023/0220734 A1 Jul. 13, 2023
US 2024/0068303 A9 Feb. 29, 2024

(30) Foreign Application Priority Data

Jun. 25, 2020 (NO) ..... 202000744

(51) Int. Cl.
*E21B 17/06* (2006.01)
*E21B 17/02* (2006.01)

(52) U.S. Cl.
CPC ..... *E21B 17/06* (2013.01); *E21B 17/023* (2013.01); *E21B 17/028* (2013.01); *E21B 2200/06* (2020.05)

(58) Field of Classification Search
CPC ..... E21B 17/06; E21B 17/023; E21B 17/028; E21B 2200/06
(Continued)

(56) References Cited

U.S. PATENT DOCUMENTS 4,660,635 A 4/1987 Wittrisch
8,141,634 B2 * 3/2012 Fisher ..... E21B 17/06 166/242.6
(Continued)

FOREIGN PATENT DOCUMENTS

EP 1460234 9/2004
GB 2263119 7/1993
(Continued)

OTHER PUBLICATIONS

Norwegian Search Report for NO20200744, dated Jan. 13, 2021.
International Search Report and the Written Opinion for PCT/NO2021/050150, dated Sep. 21, 2021.

*Primary Examiner* — Taras P Bemko
(74) *Attorney, Agent, or Firm* — Andrus Intellectual Property Law, LLP

(57) ABSTRACT

An apparatus and downhole tool having a releasable locking mechanism for holding a line reliably connected to a tool in a wellbore for providing communication with and/or power to the tool, the releasable locking mechanism has: a movable holding device that can be in a locked state for holding the line reliably connected to the downhole tool or in a released state for allowing release of the line from the tool; and a movable locking device that can be in a locking state wherein the movable locking device engages with the movable holding device in a manner that restricts movement of the movable holding device, thereby locking the movable holding device in its locked state, or that can be in a releasing state for releasing the movable holding device to its released state.

12 Claims, 11 Drawing Sheets

(58) Field of Classification Search
USPC ..... 166/382
See application file for complete search history.

(56) References Cited

U.S. PATENT DOCUMENTS

| | | | | |
|---|---|---|---|---|
| 9,784,043 | B2 * | 10/2017 | Igleheart, IV | E21B 47/06 |
| 10,012,052 | B2 | 7/2018 | Bergland et al. | |
| 10,174,573 | B2 | 1/2019 | Bakke et al. | |
| 2005/0230115 | A1 | 10/2005 | Rose | |
| 2010/0294477 | A1 | 11/2010 | Blair et al. | |
| 2011/0024133 | A1 | 2/2011 | Sach | |
| 2017/0058637 | A1 * | 3/2017 | Roessler | E21B 34/14 |
| 2020/0157905 | A1 * | 5/2020 | Massey | E21B 31/107 |
| 2020/0217148 | A1 * | 7/2020 | Massey | E21B 17/023 |
| 2021/0317723 | A1 * | 10/2021 | Wardley | E21B 23/06 |

FOREIGN PATENT DOCUMENTS

| | | |
|---|---|---|
| GB | 2515575 | 12/2014 |
| RU | 171311 | 5/2017 |

* cited by examiner

A-A

B-B

C-C

D-D

TUBE WIRE ANCHOR AND METHOD OF OPERATING THE SAME

CROSS-REFERENCE TO RELATED APPLICATIONS

This application is the U.S. national stage application of International Application PCT/NO2021/050150, filed Jun. 24, 2021, which international application was published on Dec. 30, 2021, as International Publication WO 2021/262008 in the English language. The International Application claims priority of Norwegian Patent Application No. 20200744, filed Jun. 25, 2020. The international application and Norwegian applications are all incorporated herein by reference, in entirety.

FIELD

The invention generally relates to an apparatus comprising a releasable locking mechanism for holding a line reliably connected to a tool in a wellbore for providing communication with and/or power to the tool. In an aspect of the invention, the invention relates to an electrical downhole tool comprising the releasable locking mechanism, where the downhole tool is conveyable on a coiled tubing string and connectable to topside with an electric and/or a fibreoptic line in the coiled tubing.

BACKGROUND

A line for providing communication with and/or supplying power to a downhole tool is normally terminated and secured in a locked state in a position downhole to reduce the risk of the line being disconnected from a downhole termination, particularly when used in connection with a coiled tubing. There are various known apparatuses for and methods of locking a line to secure it in position.

When operating a downhole tool conveyed on a coiled tubing string, a part of the tool and/or the coiled tubing may get stuck in the wellbore. It may then become necessary to perform a cutting operation by use of a cutting tool to allow for removal from the wellbore of parts of the coiled tubing and/or tool that are not stuck, prior to a fishing operation to release and remove a part that is stuck. If there is a line for providing communication with and/or power to the tool running downhole along the coiled-tubing string, the line may pose a problem for the cutting operation. In such scenarios, the line should be removed prior to performing the cutting operation.

For removal of the line, it may be necessary to release the line from a locked state. A method of and apparatus for locking and subsequently releasing such a line is presented in US 2011024133 A1. Said document discloses a system to connect and put in a locked state an internal line in a coiled tubing to a bottom hole assembly, where the system has a shearable device for shearing or a burstable device for bursting, which upon shearing or bursting, moves a piston to release the line from the locked state and disconnect it from the bottom hole assembly. Once released, the line may be removed from the wellbore.

A disadvantage of the prior art is that unintended shearing or bursting may occur, and that after shearing or bursting the apparatus may not be re-used or that it may require replacement of one or more parts for it to be re-used. An advantageous alternative to the prior art is presented in the following.

SUMMARY

In a first aspect, the invention relates to an apparatus comprising a releasable locking mechanism for holding a line reliably connected to a downhole tool in a wellbore for providing communication with and/or power to the downhole tool, the releasable locking mechanism comprising:

- a movable holding device that can be in a locked state holding the line reliably connected to the downhole tool or in a released state allowing release of the line from the downhole tool so that the line can be pulled out of the downhole tool together with the movable holding device; and
- a movable locking device that can be in a locking state wherein a blocking member of the movable locking device engages with the movable holding device to restrict movement of the movable holding device, thereby locking the movable holding device in its locked state, or that can be in a releasing state where the blocking member no longer engages the movable holding device, for releasing the movable holding device to its released state, wherein the apparatus comprises a tube forming a flow path for a fluid and wherein the movable locking device further comprises sleeve arranged in the tube and adapted for receiving an object for blocking the flow path and for building a fluid pressure in the tube, where the sleeve is movable by application of fluid pressure in the tube, and wherein the sleeve, when moved, operates the movable locking device from its locking state to its releasing state by freeing the blocking member from engagement with the holding device.

Release of the locking grip may be performed without a need for shearing or bursting of any kind. The apparatus according to the invention may be re-used without replacement of any parts. The apparatus may be an anchor for anchoring a line in a downhole tool. The apparatus may be referred to as a "tube wire anchor".

The releasable locking mechanism may comprise a biasing means for biasing the locking mechanism to hold the line connected to the tool. The biasing means may comprise e.g. a spring, or another suitable biasing element, to provide a force to the releasable locking mechanism, e.g. to keep the movable locking device in its locking state and/or to keep the movable holding device in its locked state.

The claimed movable locking device is operable by application of a fluid pressure. Alternatively, in a currently non-claimed embodiment, the movable locking device may be a device that is powered and/or activated e.g. electrically and arranged to move to engage with the movable holding device when activated.

The movable locking device may comprise an alternative means for blocking a flow path in the apparatus for building up a fluid pressure, wherein the alternative means for blocking the flow path may be movable to engage with the movable holding device. The alternative means for blocking the flow path may e.g. be any type of valve suitable for the purpose. The sleeve may comprise said alternative means for blocking the flow path.

In a second aspect, the invention relates to a downhole tool conveyable on a coiled tubing string, the downhole tool including the apparatus according to the first aspect of the invention. The tube of the apparatus will then typically be in fluid-communication with the main bore of the coiled tubing.

The downhole tool may be e.g. a fracking tool for performing a fracking operation in a wellbore. In alternative embodiment, the downhole tool may be an isolation tool, a tool for chemical injection, well testing or matrix stimulation etc. The downhole tool may comprise one or more packers expandable to isolate regions of a wellbore from each other. In one embodiment, the tool comprises two packers to isolate a region of the wellbore therebetween and one or more fluid ports provided between the packers, e.g. for performing fracking of the surrounding formation within the isolated region. Fluid may be supplied from the surface, via the coiled tubing and a pipe in the downhole tool and out through fluid ports in the downhole tool.

In a third aspect, the invention relates to a method of holding a line for providing communication with and/or power to a downhole tool reliably connected to the tool, the method comprising the steps of:

providing the apparatus according to the first aspect of the invention or the downhole tool according to the second aspect of the invention; and engaging the movable holding device with the movable locking device, so as to restrict movement of the movable holding device from moving and thereby moving the movable holding device into its locked state In a fourth aspect, the invention relates to a method of releasing a line for providing communication with and/or power to a downhole tool from the tool, the method comprising the steps of:

providing the apparatus according to the first aspect of the invention or the downhole tool according to the second aspect of the invention; and moving the movable locking device from its locking state to its releasing state, to release the movable holding device from its locked state to its released state; and releasing the line from the downhole tool.

The method of releasing the line may comprise the step of landing the blocking device on the sleeve, thereby blocking the flow path in the tube. The method of releasing the line may comprise the step of closing a valve of the apparatus, thereby blocking the flow path in the tube.

Furthermore, the method of releasing the line may comprise the step of building up a fluid pressure in the tube.

The method of releasing the line may further comprise the step of moving the sleeve into the second position by application of fluid pressure to the sleeve, directly or indirectly, thereby moving the movable locking device from its locking state to its releasing state.

The method of releasing the line may further comprise the step of engaging the movable locking device by moving the sleeve to its second position, such as to move the movable locking device from its locking state to its releasing state.

The sleeve may comprise a recess for receiving the movable locking device. The movable locking device may e.g. sit in the recess when the movable locking device is in its locking state and be forced out of the recess when the sleeve is moved to its second position. Or, alternatively, the recess may be moved to the movable locking device when the sleeve is moved to its second position so as to allow movement of the movable locking device into the recess and thereby allow movement of the movable locking device into its releasing state.

The method of holding the line may comprise the step of applying a biasing force by use of a biasing means to hold the movable holding device in its locked state, directly or indirectly.

The apparatus may comprise one or more biasing means that may be arranged to act directly on the movable holding device to keep it in its locked state, or/and that may be arranged to act on the movable locking device to keep the movable locking device in its locking state, or/and that may be arranged to act on the sleeve to keep it in its first position.

Alternatively, or additionally, the apparatus may comprise biasing means that e.g. is arranged to move the movable locking device from its locking state to its releasing state, e.g. for the movable locking device to move to its releasing state when the sleeve is in its second position, e.g. by moving the movable locking device into a recess in the sleeve.

The apparatus may further comprise a support device for supporting the sleeve to keep it in position in the tube. The support device may comprise one or more biasing means to apply a mechanical force against the sleeve to help keep the sleeve in position. The support device may further comprise a friction device to keep the sleeve from moving from its position.

The method may comprise one or more of the following steps:

conveying a tool downhole in a wellbore by use of a coiled tubing, the tool comprising the apparatus according to the first aspect of the invention;

providing the object to block the flow path in the tube;

closing a valve of the apparatus;

building up a fluid pressure in the tube to apply the fluid pressure to the object; thereby applying a force to the sleeve; and/or moving the sleeve by application of a force to the sleeve and thereby moving the movable locking device.

BRIEF DESCRIPTION OF THE DRAWINGS

In the following is described examples of preferred embodiments illustrated in the accompanying drawings, wherein.

DETAILED DESCRIPTION OF THE DRAWINGS

Note that the figures are mere representations of embodiments of the first and the second aspects of the invention meant to illustrate some features. Some details of the embodiments that would or could have been included in actual physical embodiments of the inventions may have been left out from the figures, and the figures are not necessarily drawn to scale.

Figure 1:
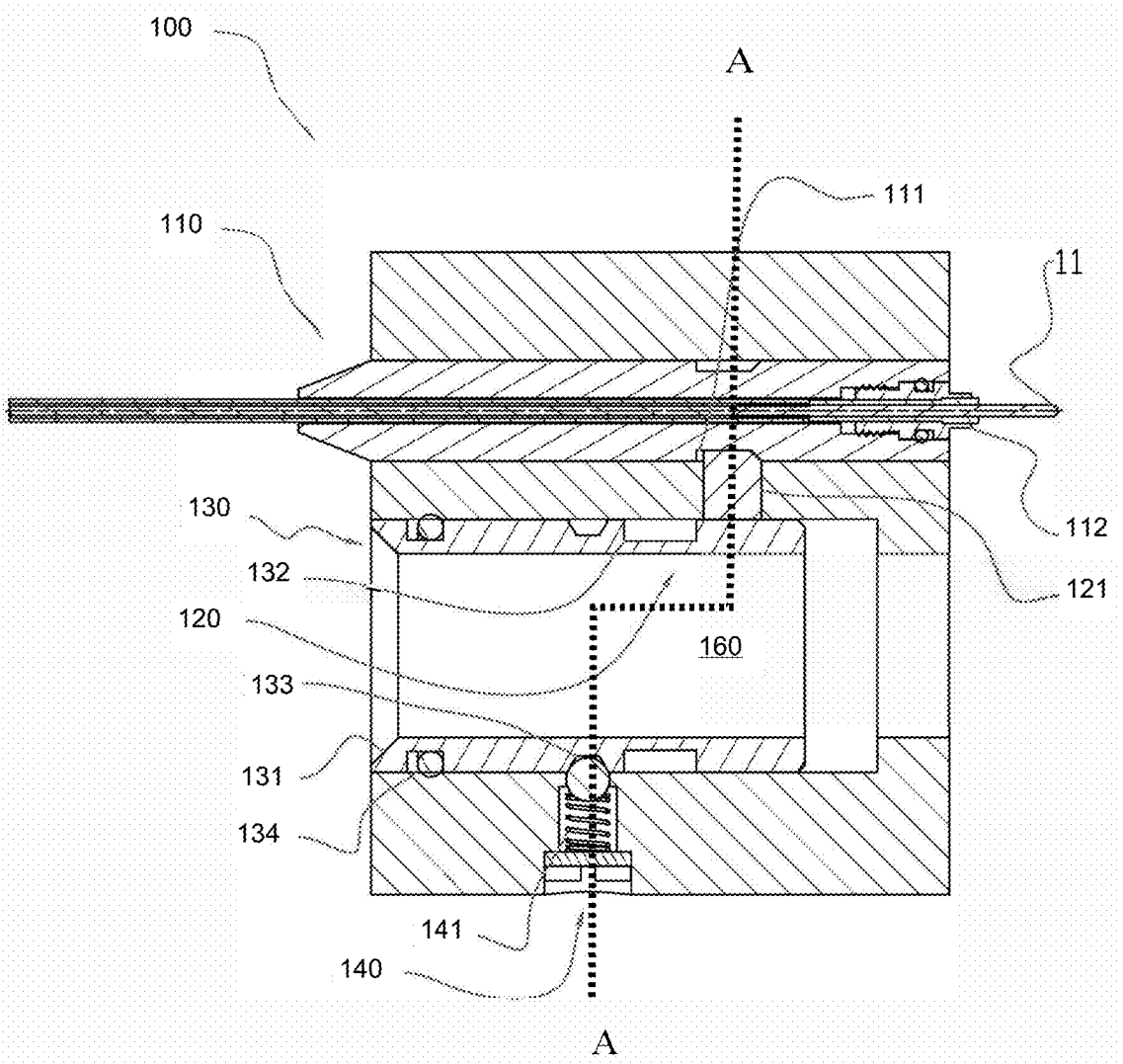
FIG. 1 to 4 are cross-sectional side-views of a first embodiment of the apparatus according to the first aspect of the invention.

FIG. 1 shows a first embodiment of the apparatus 100 according to the first aspect of the invention, wherein a holding device/line termination 110 of the apparatus 100 is locked in its locked state by the movable locking device 120. A line 11 is held/terminated by the holding device 110 and locked in a position for being securely connected to a not shown tool.

The termination/holding device 110 is formed with a recess 111 for receiving a blocking member 121, here in the form of a simple block, of the locking device 120. The blocking member 121, while in the recess, prevents movement of the holding device 110, thus locking the holding device/line termination 110 in its locked state. In an alternative, not shown embodiment, the holding device 110 may e.g. have one or more protrusions in a body of the holding device 110 that may be arranged to engage with e.g. a blocking member 121 of the locking device 120 for locking the holding device 110 in its locked state.

The apparatus 100 further has a sleeve 130 and optionally a biasing means 140. The sleeve 130, forming a part of the movable locking device, has a seat 131 for receiving an object, such as a ball or a dart, for blocking a flow path 160 in the apparatus 100, a first recess 132 for receiving the blocking member 121, a second recess 133 for receiving a part of the biasing means 140, a third recess 134 for receiving a seal. In the shown embodiment, the biasing means 140 comprises a spring 141 for pushing an object into the second recess 133 of the sleeve 130 and against the sleeve 130 to add a force against the sleeve 130 to prevent unwanted movement of the sleeve 130. The seat may be specifically shaped to receive and make a good fit with the object, such as a ball, to be received, or the seat may simply be a straight edge portion of the sleeve.

Figure 2:
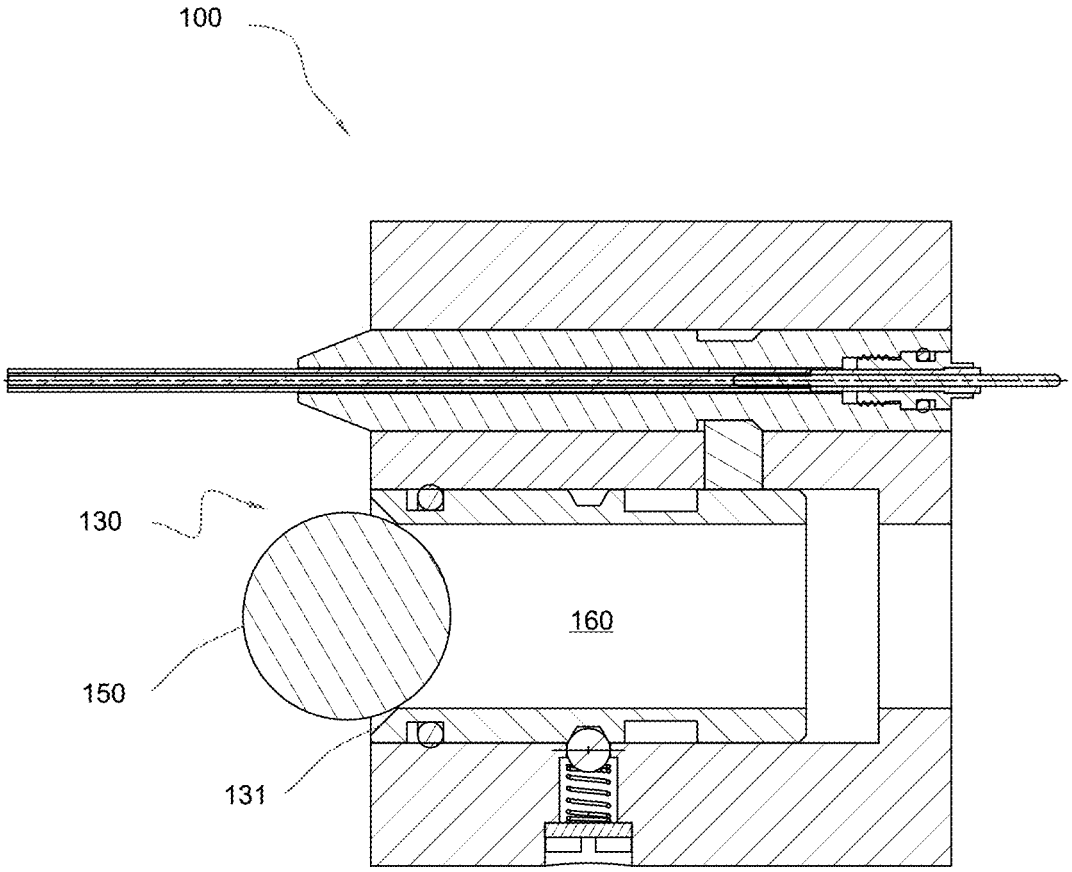

In FIG. 2, a ball 150 has been received by the seat 131 of the sleeve 130 of the apparatus 100, thus blocking the flow path 160. The blockage caused by the ball 150 allows for a pressure build-up that may be utilized to force the sleeve 130 to move axially into the well, i.e. to the right in the figure.

Figure 3:
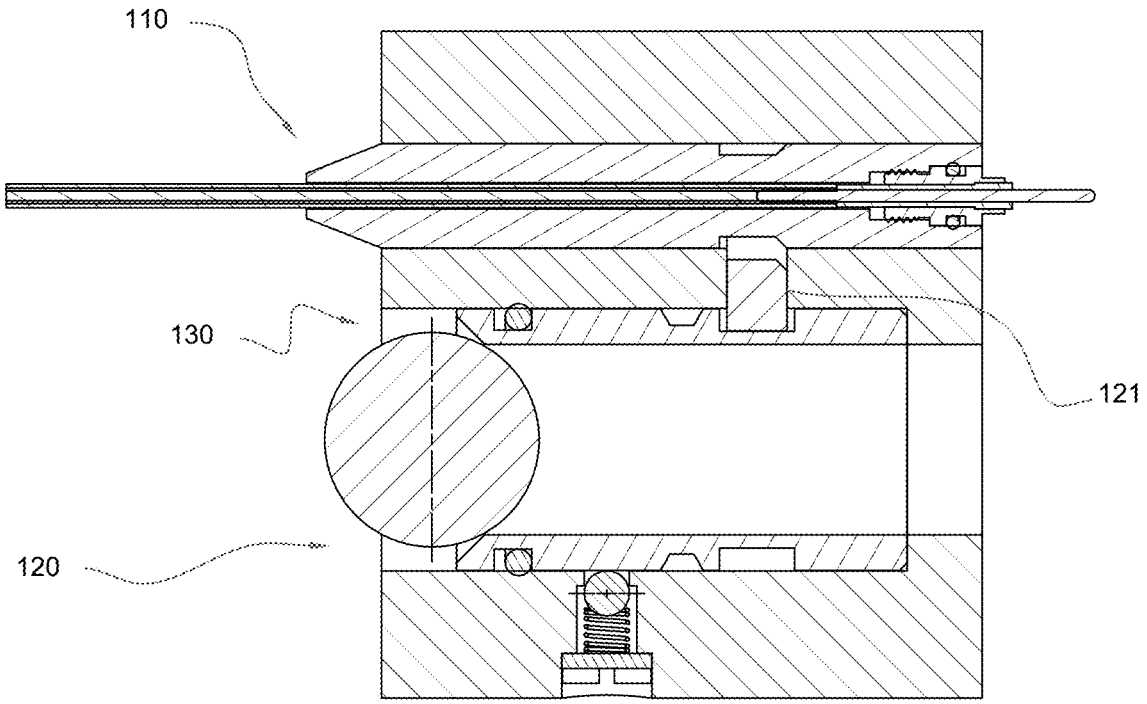

In FIG. 3, a fluid pressure has been used to push the sleeve 130 inwardly, i.e. to the right in the drawing, relative to the rest of the apparatus 100 and into a position wherein the first recess 132 of the sleeve 130 is in position for receiving the block 121. The block 121 may fall down into the second recess 132 simply by means of gravity and/or the block may be biased e.g. by use of a not shown second biasing means, such as a spring, for moving/pushing into the first recess 132 of the sleeve 130 when the first recess 132 is in position for receiving the blocking member 121.

When the blocking member 121 has moved into the first recess 132, it is freed from the mechanical interaction with the line termination 110, whereby the movable locking device 120 is no longer in its locking state, as it is in FIGS. 1 and 2. Instead the movable locking device 120 is in its releasing state, wherein the movable holding device/line termination 110 is released to its released state and may be pulled out of the tool together with the line.

Figure 4:
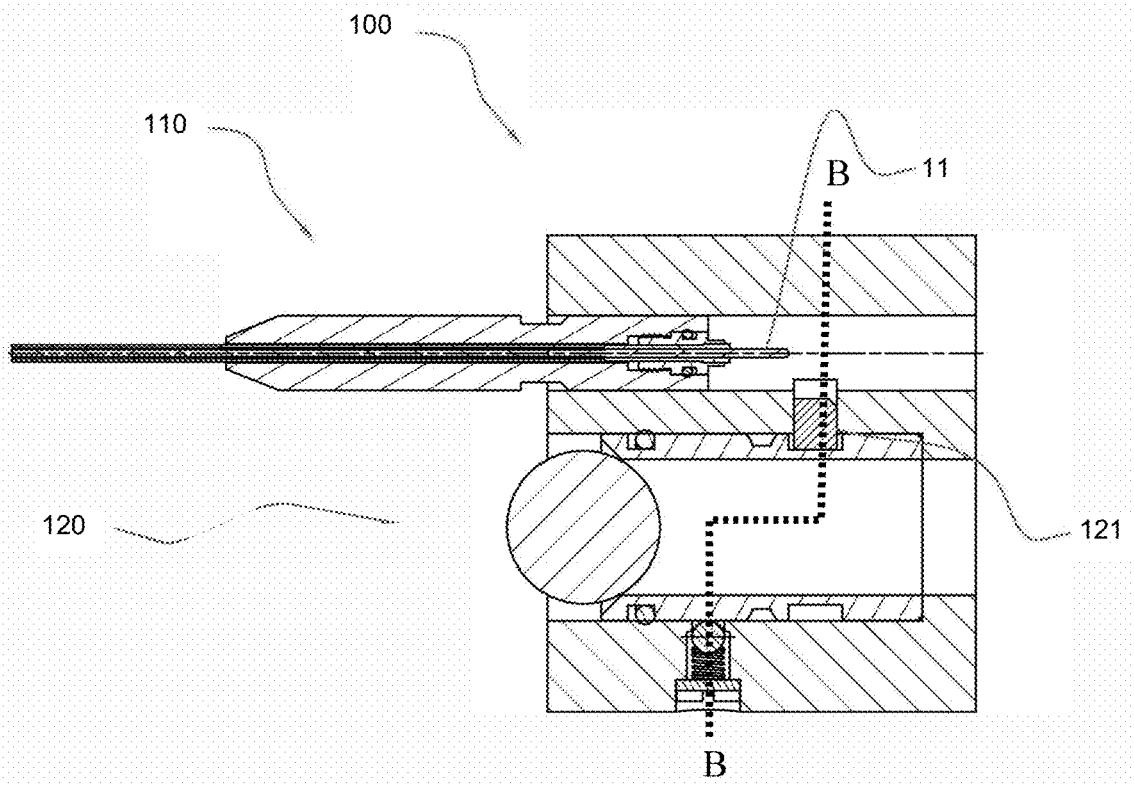

In FIG. 4, the movable locking device 120 is in its releasing state and the termination 110 has been released and is seen pulled back, typically by pulling the line 11 from topside. The line 11 pulled with termination 110 and thus the line 11 is released from its connection to the not shown tool.

Figure 5:
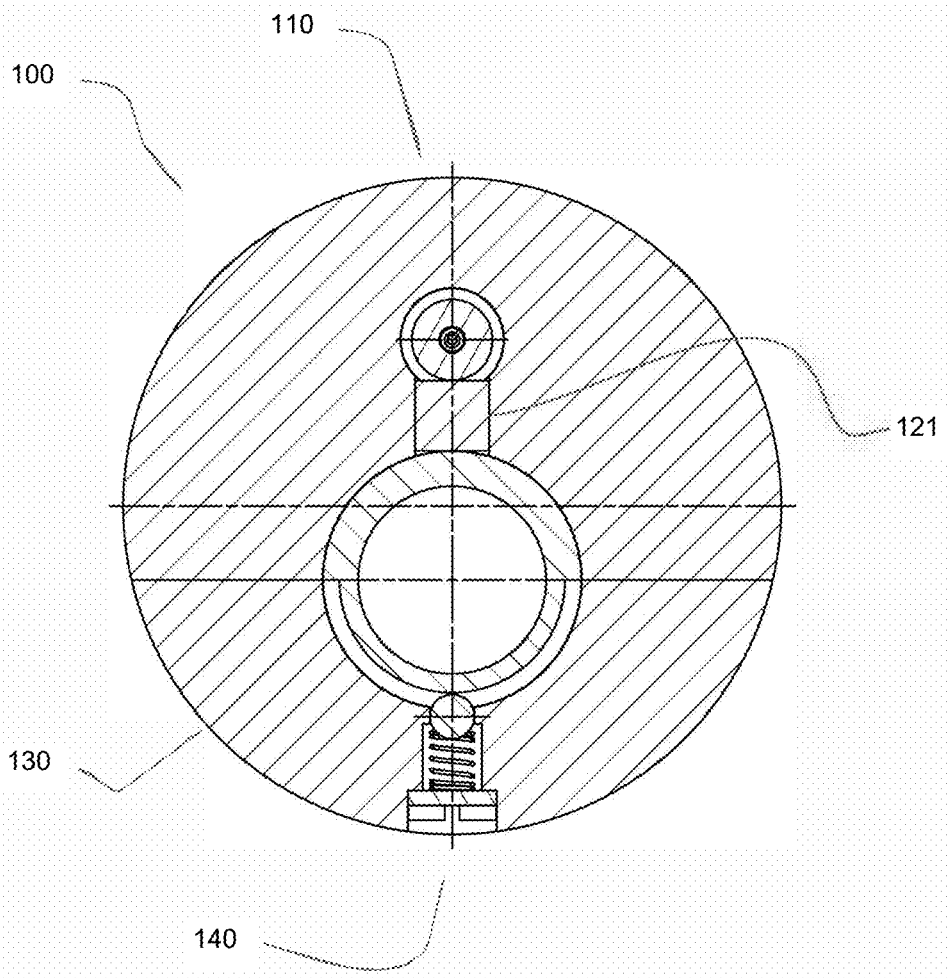
FIGS. 5 & 6 are cross-sectional front-views of the first embodiment of the apparatus according to the first aspect of the invention.

FIG. 5 shows a cross-sectional front-view through the line A-A, i.e. at two different depths, of the apparatus 100 shown in FIGS. 1 to 4, in the state shown in FIG. 1, to illustrate from another point of view how the biasing means acts on the sleeve 130 and how the sleeve 130 blocks movement of the blocking member 121 and how the movable blocking member 121 engages with the movable holding device 110. As the pressure drop across the sleeve 130 will be very low, the biasing means may be regarded as optional.

Figure 6:
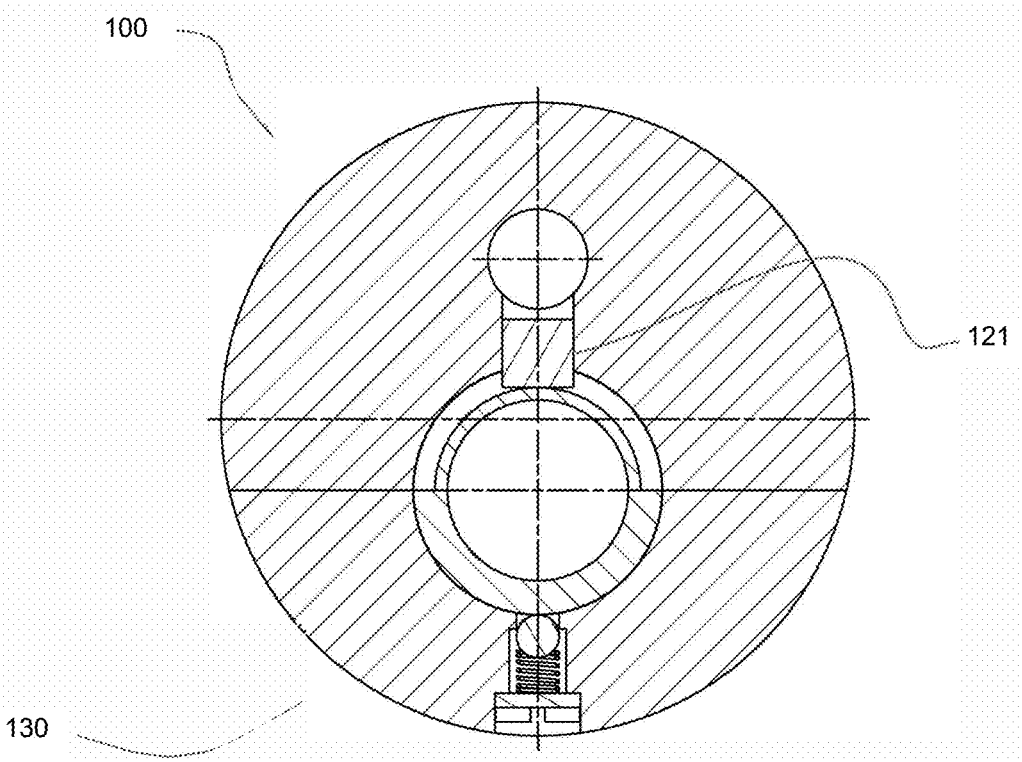

FIG. 6 shows a similar view and apparatus, also at two different depths, as FIG. 5, but through the line B-B from FIG. 4, wherein the blocking member 121 has been received in the sleeve 130 and the termination 110 has been pulled back and out of the view shown in FIG. 6.

FIGS. 7 to 10 show an alternative embodiment of the apparatus 100. The movable locking device 120 of the apparatus 100 comprises a blocking member 121 for engaging with the movable holding device/termination 110. In this embodiment, the blocking member 121 is formed with an oval opening encircling the termination 110 in the line bore of the tool, the oval opening having its length in the vertical direction. The blocking member thus functions as an eccentric lock with the appearance of a cigar cutter operating in reverse, as can be best seen in FIGS. 9 and 10. The oval opening is formed integrally with a horizontal platform/base being biased vertically towards the sleeve by means a set of springs, as will be explained below. Furthermore, the apparatus 100 comprises a tube for forming a flow path 160 for a fluid, a biasing means 140 for holding a sleeve 130 in position, the sleeve being formed with a first recess 132 in which the blocking member is initially received, a second recess 133 for receiving the biasing means, a third recess 134 for receiving a seal and a seat 131 for receiving an object, such as a ball or a dart, for blocking the flow path 160.

The apparatus 100 shown in FIGS. 7 to 10 is different from the apparatus 100 shown in FIGS. 1 to 6 e.g. in the design and functionality of the locking device 120.

Figure 7:
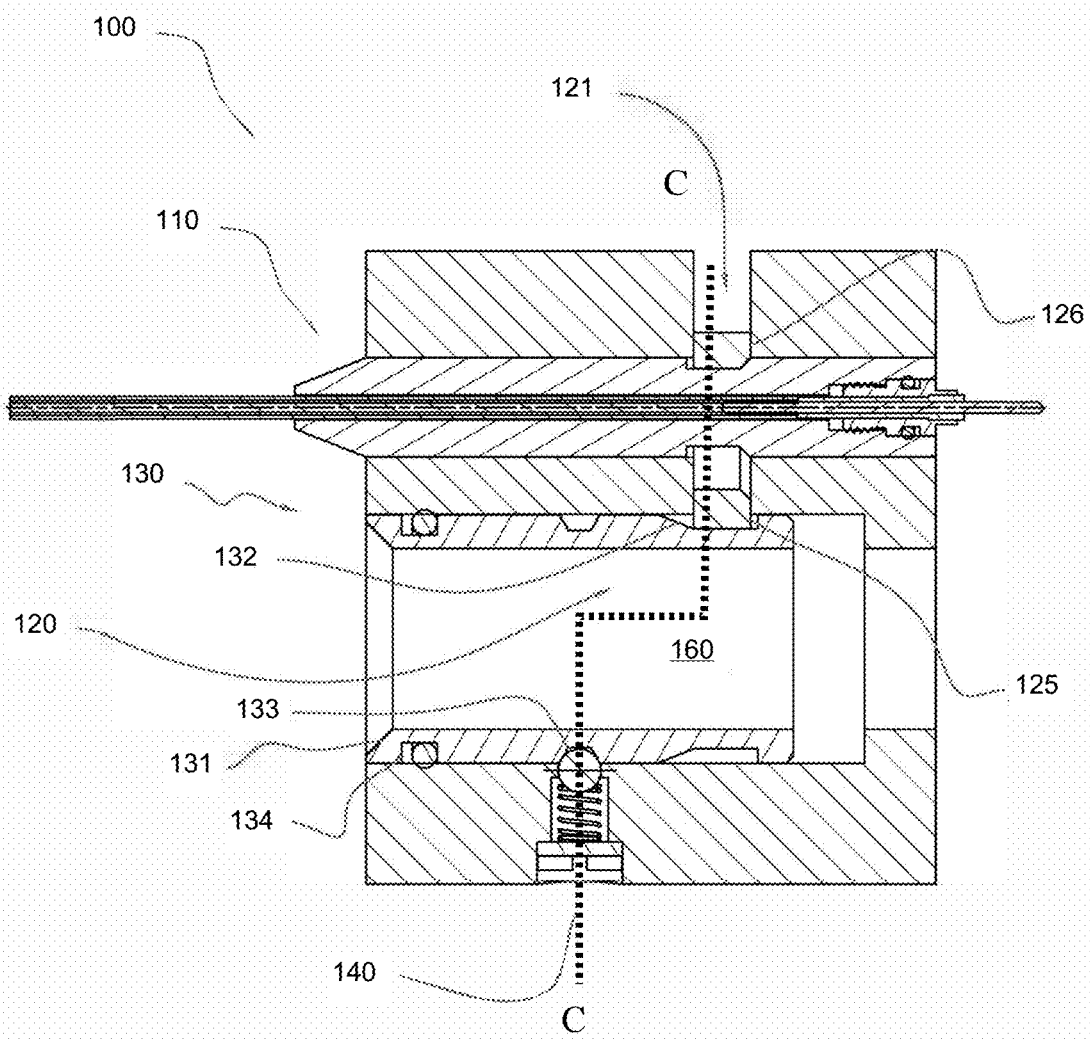
FIGS. 7 & 8 are cross-sectional side-views of a second embodiment of the apparatus.

FIG. 7 shows how the blocking member 121 is arranged such that a lower part 125 of the blocking member 121 sits in the first recess 132 of the sleeve 130 when the locking device 120 is in its locking state and that simultaneously an upper part 126 of the blocking member 121 engages with a recess in the termination 110 to prevent movement of the termination. As can be best seen FIG. 9, the termination 110 is positioned in/encircled by the oval opening in the blocking member 121. The termination 110 is positioned eccentrically in the oval opening of the blocking device 121, as can be seen in FIG. 9 where centre of the termination is shown off-centre in oval opening, and it is thereby locked in place by the locking device 121.

Figure 8:
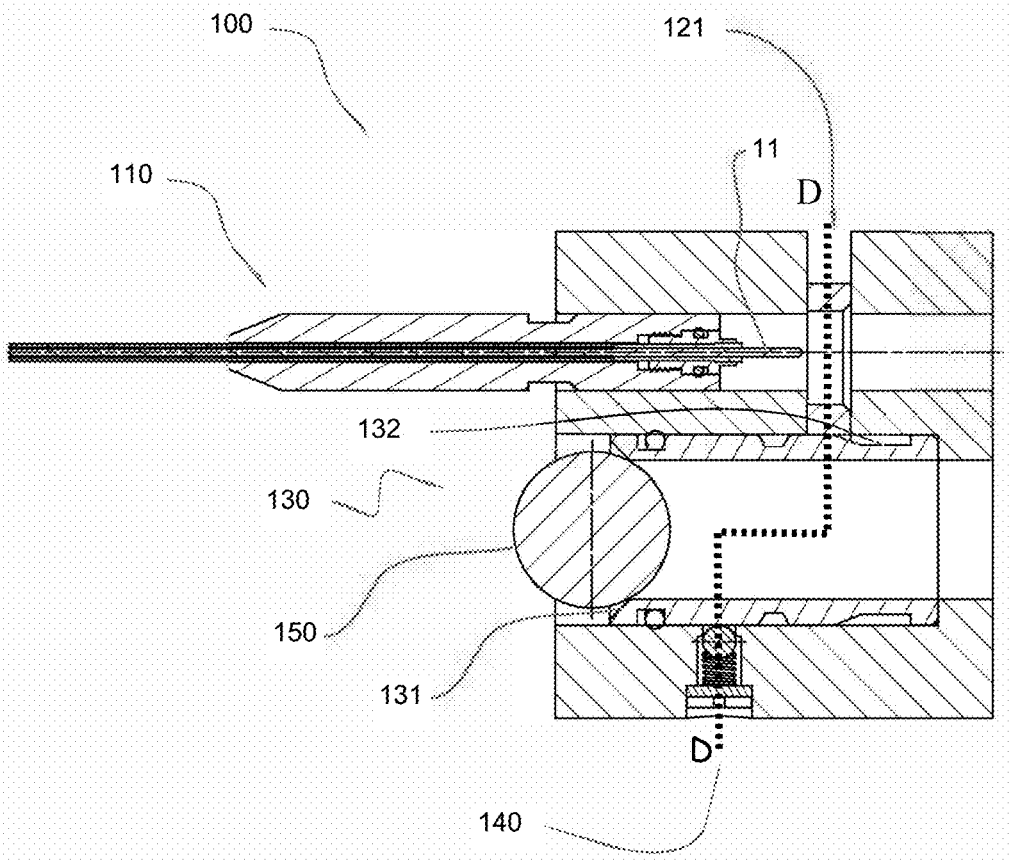

The recess 132 in the sleeve is formed with an inclined surface so that when the sleeve is pushed axially into the main bore of the tool, the blocking member 121 will glide upwardly to be lifted out of the recess 132 and from its locking grip on the termination 110. FIG. 8 shows how movement of the sleeve 130 following insertion of a ball 150 to block the flow path 160 and a pressure build-up in the tube forces/lifts the blocking member 121 upwards, moving the blocking member out of the first recess 132 in the sleeve 130, and more importantly, out of the recess of the movable holding device/termination 110 such as to not engage in a movement-preventing way with the movable holding device 110. In FIG. 8, the movable locking device 120 is in its releasing state, and the movable holding device 110 is released and pulled back together with the line to disconnect the line from a downhole termination to a not shown tool.

Figure 9:
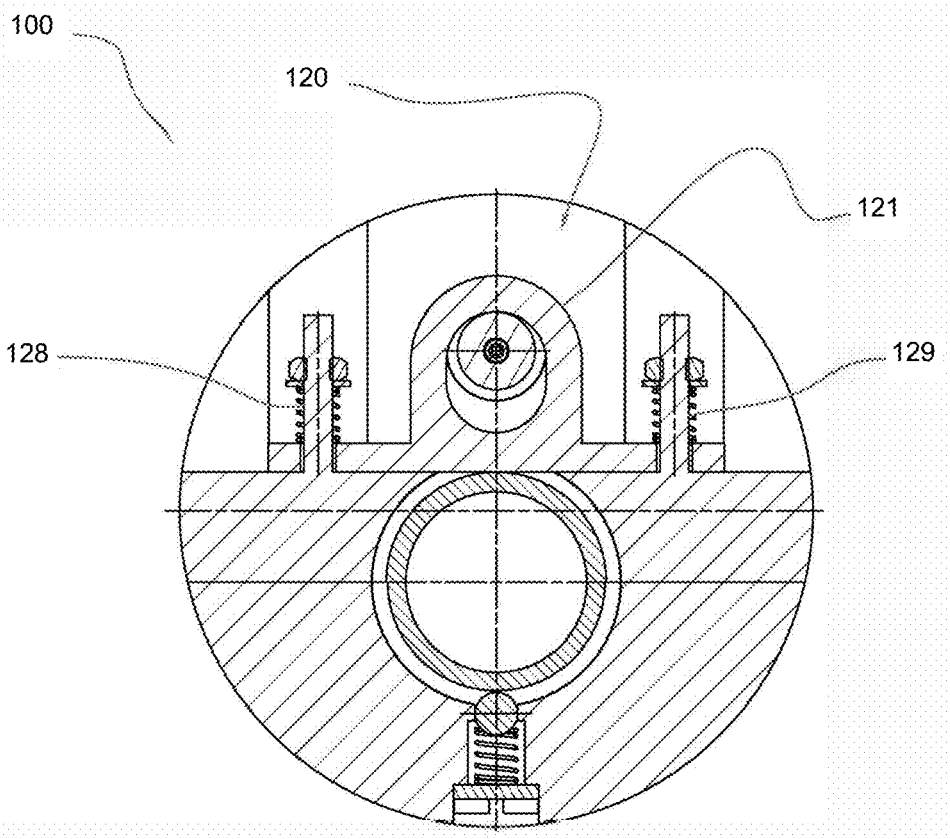
FIGS. 9 & 10 are cross-sectional front-views of the second embodiment of the apparatus.
Figure 10:
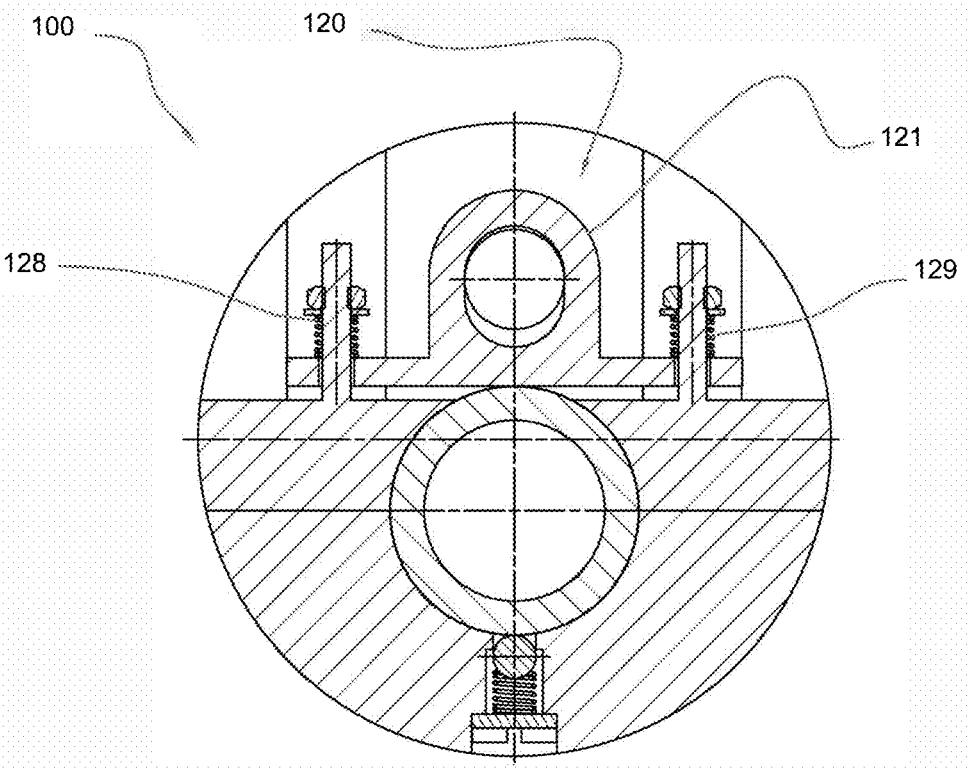

FIGS. 9 and 10 show the apparatus 100 in the state shown in FIGS. 7 and 8 through the lines C-C and D-D, respectively in a cross-sectional schematic front-view through two different depths. These figures show in greater detail the design of the blocking member 121, and that the apparatus 100 and the locking device 120 in this embodiment has a second means 128, 129 for biasing the blocking member 121 downwards against the sleeve 130, herein the form of a pair of compression springs encircling a pair of bolts/studs, and held in place by nuts. Bolts are through-going in bores in the base portion of the blocking member and connected to the main mandrel of the tool, whereby the compression springs, held around the bolts and between the nuts and the base plate, are biasing the blocking member 121 vertically downwardly to hold the blocking member in its locking engagement with the termination 110.

All the biasing means 140, 128, 129 shown in the figures are shown to be spring-biased. A skilled person will know that other types of biasing means could be used to achieve the purpose of the biasing means 140, 128, 129.

Figure 11:
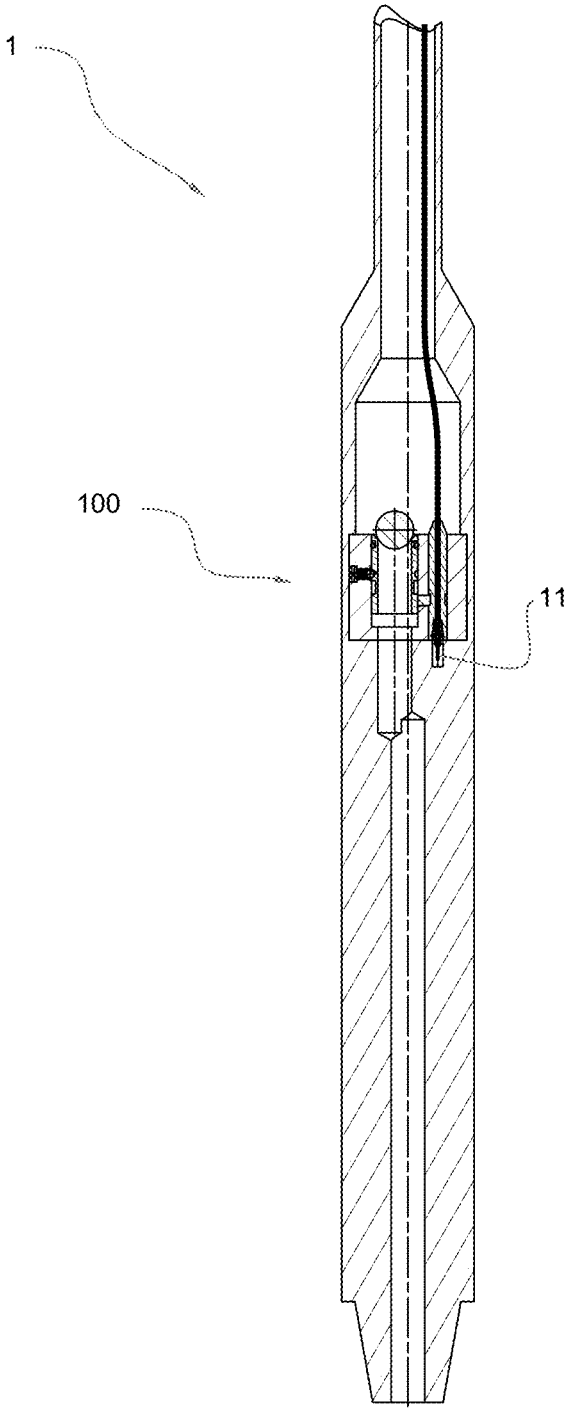
FIG. 11 is a cross-section side-view of the downhole tool according to the second aspect of the invention.

FIG. 11 shows a tool 1 comprising the apparatus 100, wherein the line 11 Is terminated in the tool 1 and secured in position by the apparatus 100. The tool 1 is a downhole tool, conveyable on a coiled tubing, but other types of tools could comprise the apparatus 100.

Although the figures merely illustrate embodiments wherein a ball 150 is landed on a seat 131 of a sleeve 130 to block a flow-path 160 in a tube to facilitate for a pressure build-up, a skilled person will understand that other solutions may be possible for facilitating a pressure build-up and using said pressure build-up to move the movable locking device 120 directly or indirectly. It may also be possible to move the movable locking device 120 without using a pressure build-up in a tube of the apparatus 100, e.g. by having the apparatus including and driving an electrical motor to move the movable locking device 120.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention claimed is:

1. An apparatus comprising a releasable locking mechanism for holding a line reliably connected to a downhole tool in a wellbore for providing communication with and/or power to the downhole tool, the releasable locking mechanism comprising:

a movable holding device that can be in a locked state holding the line reliably connected to the downhole tool or in a released state allowing release of the line from the downhole tool so that the line can be pulled out of the downhole tool together with the movable holding device; and a movable locking device that can be in a locking state wherein a blocking member of the movable locking device engages the movable locking device with the movable holding device to restrict movement of the movable holding device, thereby locking the movable holding device in the locked state, or that can be in a releasing state where the blocking member no longer engages the movable locking device with the movable holding device, for releasing the movable holding device to the released state, wherein the apparatus comprises a tube forming a flow path for a fluid, and wherein the movable locking device further comprises an axially elongated sleeve arranged in the tube and adapted for receiving an object for blocking the flow path and for building a fluid pressure in the tube, wherein the sleeve is axially movable by application of the fluid pressure in the tube, and wherein axial movement of the sleeve frees the blocking member to move radially relative to the sleeve to disengage the movable locking device from the movable holding device and thus place the movable holding device in the released state.

2. A downhole tool conveyable on a coiled tubing string, the downhole tool comprising the apparatus according to claim 1.

3. The downhole tool according to claim 2, wherein the downhole tool is an isolation or fracking tool.

4. A method of holding a line for a downhole tool in a wellbore reliably connected to the downhole tool, the method comprising the steps of:

providing the apparatus according to claim 1; and engaging the movable holding device with the blocking member of the movable locking device, so as to restrict movement of the movable holding device from moving and thereby moving the movable holding device into the locked state.

5. The method according to claim 4, further comprising the steps of:

landing the object on the sleeve, thereby blocking the flow path in the tube;

moving the sleeve by application of the fluid pressure and thereby operating the movable locking device from the locking state to the releasing state by freeing the blocking member from engagement with the holding device; and pulling the line out of the downhole tool together with the movable holding device.

6. An apparatus comprising a releasable locking mechanism for holding a line reliably connected to a downhole tool in a wellbore for providing communication with and/or power to the downhole tool, the releasable locking mechanism comprising:

a movable holding device that can be in a locked state holding the line reliably connected to the downhole tool or in a released state allowing release of the line from the downhole tool so that the line can be pulled out of the downhole tool together with the movable holding device; and a movable locking device that can be in a locking state wherein a blocking member of the movable locking device engages the movable locking device with the movable holding device to restrict movement of the movable holding device, thereby locking the movable holding device in the locked state, or that can be in a releasing state where the blocking member no longer engages the movable locking device with the movable holding device, for releasing the movable holding device to the released state, wherein the apparatus comprises a tube forming a flow path for a fluid and wherein the movable locking device further comprises sleeve arranged in the tube and adapted for receiving an object for blocking the flow path and for building a fluid pressure in the tube, wherein the sleeve is movable by application of the fluid pressure in the tube, and wherein the sleeve, when moved, operates the movable locking device from the locking state to the releasing state by freeing the blocking member from engagement between the movable locking device and the movable holding device, wherein the apparatus comprises a support device including one or more biasing means for applying a mechanical pushing force against the sleeve to keep the sleeve in position in the tube prior to building the fluid pressure in the tube.

7. The apparatus according to claim 6, wherein the sleeve is formed with a recess into which the blocking member may fall and/or be forced up-on movement of the sleeve to free the blocking member from engagement with the movable holding device.

8. The apparatus according to claim 6, wherein the sleeve is formed with a recess having an inclined side portion on which the blocking member may glide to be lifted out from the recess upon movement of the sleeve to free the blocking member from engagement with the holding device.

9. An apparatus comprising a releasable locking mechanism for holding a line reliably connected to a downhole tool in a wellbore for providing communication with and/or power to the downhole tool, the releasable locking mechanism comprising:

a movable holding device that can be in a locked state holding the line reliably connected to the downhole tool or in a released state allowing release of the line from the downhole tool so that the line can be pulled out of the downhole tool together with the movable holding device; and a movable locking device that can be in a locking state wherein a blocking member of the movable locking device engages the movable locking device with the movable holding device to restrict movement of the movable holding device, thereby locking the movable holding device in the locked state, or that can be in a releasing state where the blocking member no longer engages the movable locking device with the movable holding device, for releasing the movable holding device to the released state, wherein the apparatus comprises a tube forming a flow path for a fluid and wherein the movable locking device further comprises sleeve arranged in the tube and adapted for receiving an object for blocking the flow path and for building a fluid pressure in the tube, wherein the sleeve is movable by application of the fluid pressure in the tube, and wherein the sleeve, when moved, operates the movable locking device from the locking state to the releasing state by freeing the blocking member from engagement between the movable locking device and the movable holding device, wherein the sleeve is formed with a recess into which the blocking member may fall and/or be forced up-on movement of the sleeve to disengage the movable locking device from the movable holding device.

10. The apparatus according claim 9, where the blocking member is biased downwardly against the sleeve.

11. An apparatus comprising a releasable locking mechanism for holding a line reliably connected to a downhole tool in a wellbore for providing communication with and/or power to the downhole tool, the releasable locking mechanism comprising:

a movable holding device that can be in a locked state holding the line reliably connected to the downhole tool or in a released state allowing release of the line from the downhole tool so that the line can be pulled out of the downhole tool together with the movable holding device; and a movable locking device that can be in a locking state wherein a blocking member of the movable locking device engages the movable locking device with the movable holding device to restrict movement of the movable holding device, thereby locking the movable holding device in the locked state, or that can be in a releasing state where the blocking member no longer engages the movable locking device with the movable holding device, for releasing the movable holding device to the released state, wherein the apparatus comprises a tube forming a flow path for a fluid and wherein the movable locking device further comprises sleeve arranged in the tube and adapted for receiving an object for blocking the flow path and for building a fluid pressure in the tube, wherein the sleeve is movable by application of the fluid pressure in the tube, and wherein the sleeve, when moved, operates the movable locking device from the locking state to the releasing state by freeing the blocking member from engagement between the movable locking device and the movable holding device, wherein the sleeve is formed with a recess having an inclined side portion on which the blocking member may glide to be lifted out from the recess upon movement of the sleeve to disengage the movable locking device from the movable holding device.

12. The apparatus according claim 11, where the blocking member is biased downwardly against the sleeve.

* * * * *